United States Patent [19]

Waterbury

[11] 4,127,212

[45] Nov. 28, 1978

[54] VENDABLE RECLOSABLE BEVERAGE CONTAINER

[76] Inventor: Nelson J. Waterbury, Marschall Str 9, 8 Munich 40, Germany

[21] Appl. No.: 869,295

[22] Filed: Jan. 13, 1978

Related U.S. Application Data

[63] Continuation of Ser. No. 763,716, Jan. 28, 1977, abandoned, which is a continuation-in-part of Ser. No. 723,709, Sep. 16, 1976, abandoned, which is a continuation-in-part of Ser. No. 705,682, Jul. 15, 1976, abandoned, which is a continuation-in-part of Ser. No. 699,240, Jun. 24, 1976, abandoned.

[51] Int. Cl.[2] ..... B65D 51/18

[52] U.S. Cl. ..... 220/254; 220/344; 220/90.4; 220/346

[58] Field of Search ..... 220/268, 269, 270, 307, 220/331, 336, 344, 354, 359, 90.4, 346

[56] References Cited

U.S. PATENT DOCUMENTS

| | | | |
|---|---|---|---|
| 1,765,284 | 6/1930 | Prosnitz | 220/254 |
| 2,159,978 | 5/1939 | Parkin | 220/254 |
| 2,538,946 | 1/1951 | Nyden | 220/254 |
| 2,757,859 | 8/1956 | Holland | 220/254 |
| 3,705,671 | 12/1972 | Douty | 220/336 |
| 3,938,690 | 2/1976 | Butler | 220/348 |

*Primary Examiner*—Ro E. Hart

*Attorney, Agent, or Firm*—Brumbaugh, Graves, Donohue & Raymond

[57] ABSTRACT

A rigid container having an opening in a rigid lid thereof, a slidable cap recessed beneath the upper end of the container movable into position over said opening in the lid, and a seal on the lid and cap to provide an easy-to-open sealed closure which cannot be removed from the lid or dropped into the container.

41 Claims, 17 Drawing Figures

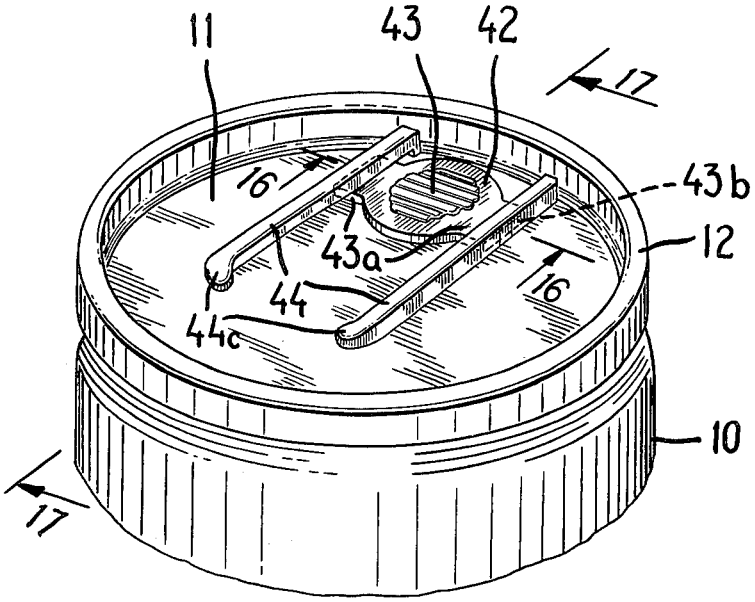
FIG. 13
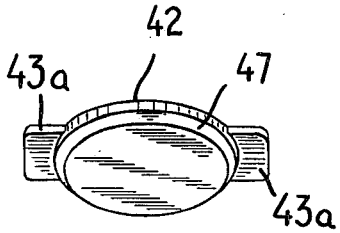
FIG. 15
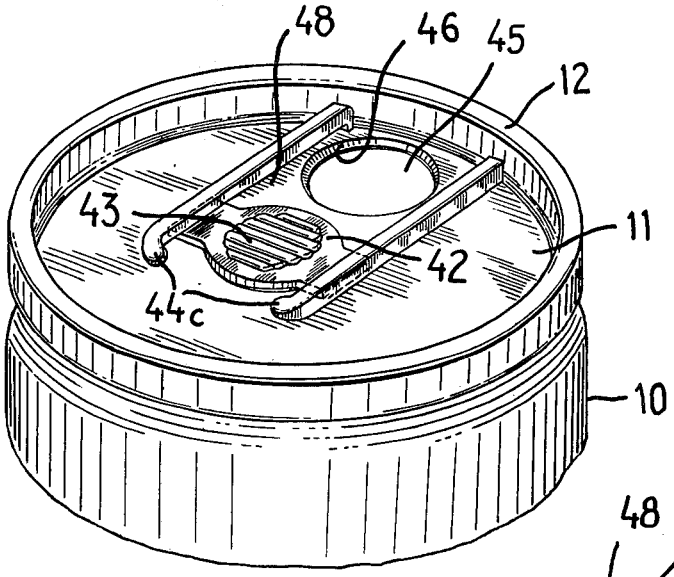
FIG. 14
FIG. 16
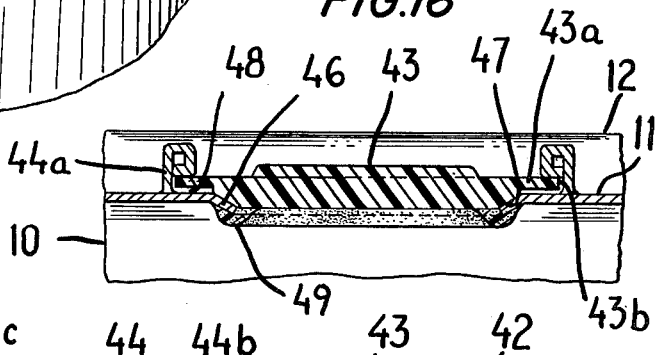
FIG. 17
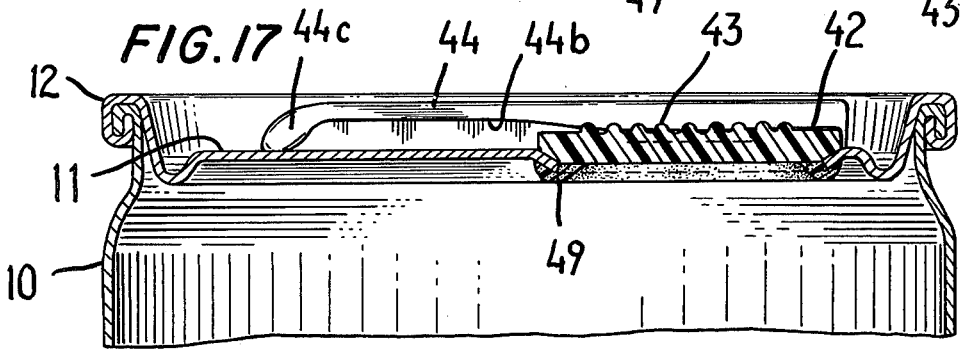

VENDABLE RECLOSABLE BEVERAGE CONTAINER

This application is a continuation of application Ser. No. 763,716 filed Jan. 28, 1977, now abandon, which is a continuation-in-part of my copending application, Ser. No. 723,709, filed Sept. 16, 1976, now abandon, which was a continuation-in-part of my copending application, Ser. No. 705,682, filed July 15, 1976, now abandoned, which in turn was a continuation-in-part of my copending application, Ser. No. 699,240, filed June 24, 1976, now abandoned.

The invention relates to containers, for example, sealed containers of the type used to vend beverages and foods, and more particularly to a rigid container having an opening in a lid thereof, a slidable cap recessed beneath the upper end of the container and movable into position over the opening, and a seal on the lid and cap to provide an easy-to-open sealed closure which can be reclosed. The cap cannot be removed from the lid or dropped into the container.

Containers having upstanding pouring spouts or necks sealed by caps threaded onto the necks or spouts have long been in widespread use. Containers of this type have limitations, inter alia, in that the tops and bottoms thereof are not of uniform shape and size and cannot be stacked. The more recent "flip-top" tab closures overcome this disadvantage of necked or spouted containers, but they have other disadvantages, such as sharp edges which can cut the skin, a difficult to lift ring that can damage fingernails and the danger that the closure tab will be dropped into the container and accidentally swallowed.

The container of the present invention overcomes these disadvantages and provides a vendable airtight container which can be stacked, easily opened without injury to the user and then resealed to store the unused contents. The recessed cap makes it possible for the shape and size of the top and bottom of the container to be made uniform so that the containers can be stacked, packaged and handled in the manner of conventional metal cans. In the preferred form of the container, the cap can be easily pulled or pushed across the lid away from the opening to dispense the contents from the container. After sliding the cap away from the opening, it remains on the lid and cannot be lost or dropped back into the container through the opening. Thus there is no debris apart from the container and there is no danger that the cap will be swallowed accidentally by the user. Moreover, the cap can be easily slipped back across the lid to reclose the opening for the storage of the unused container contents.

In accordance with the present invention, a guideway for guiding the cap on the lid can be formed by a pair of parallel channels which receive opposite sides of the cap. The channels may be affixed to the lid or formed integrally with the lid. The channels also function with the chime as two sides of a three-sided miniature spout which facilitates pouring of liquid from the container opening.

For a complete understanding of the present invention, reference can be made to the detailed description which follows and to the accompanying drawings, in which FIG. 1 is a perspective view of the upper portion of a container embodying the present invention;

FIG. 13 is a perspective view of a container embodying still another form of the present invention showing the slidable cap in sealed position;

FIG. 14 is a perspective view similar to FIG. 13 showing the slidable cap in open position;

FIG. 15 is a perspective view of the slidable cap of the embodiment shown in FIGS. 13 and 14; and FIGS. 16 and 17 are sectional views along the lines 16—16 and 17—17, respectively, of FIG. 13 looking in the direction of the arrows.

Figure 1:
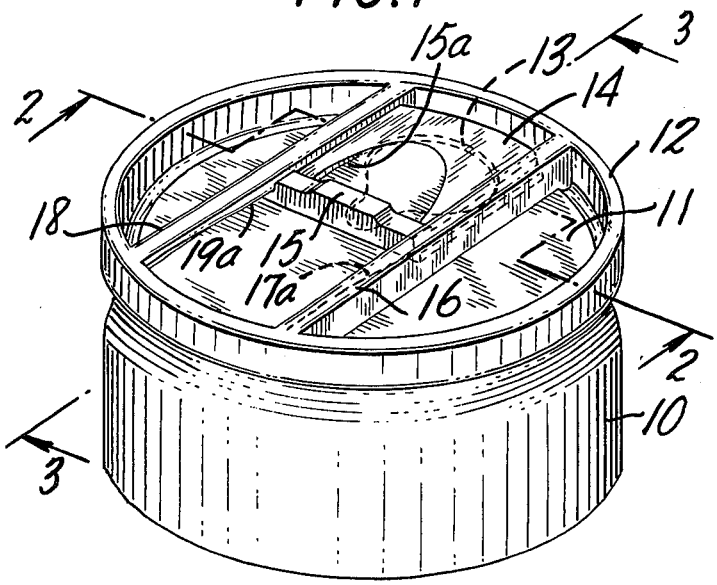
Figure 2:
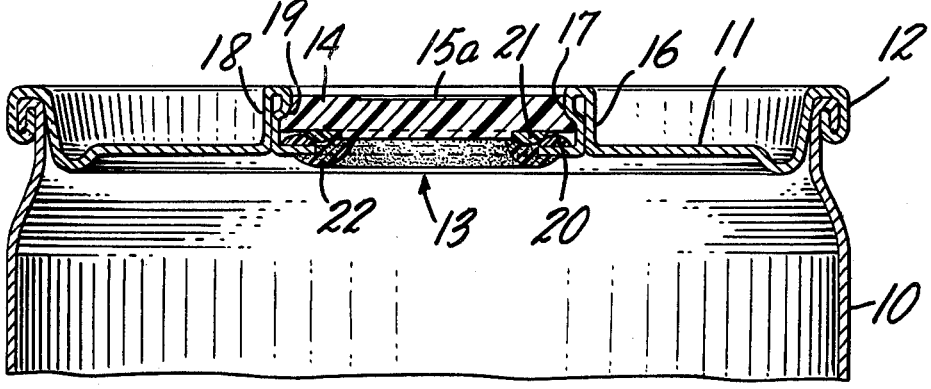
FIG. 2 is a cross-sectional view of the upper end of the container taken along the line 2—2 of FIG. 1 looking in the direction of the arrows.
Figure 3:
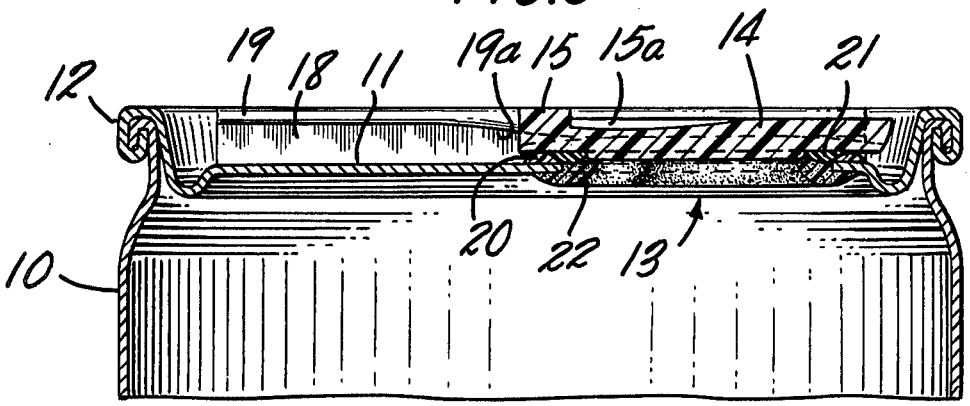
FIG. 3 is a cross-sectional view of the upper end of the container taken along the line 3—3 of FIG. 1 looking in the direction of the arrows.
Figure 4:
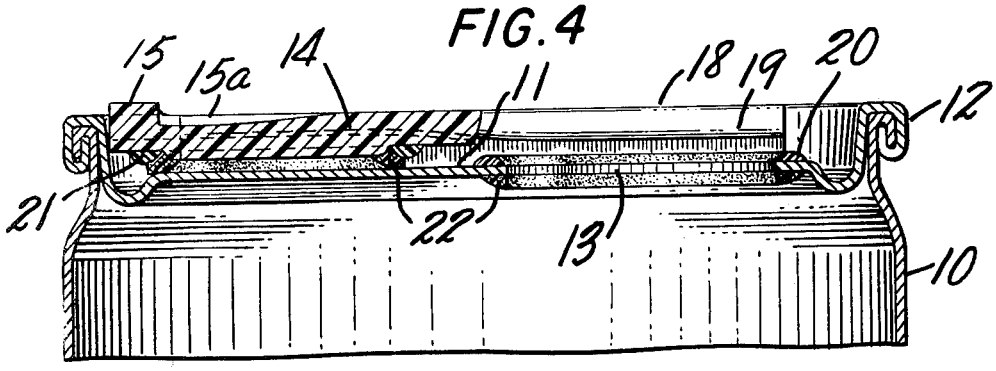
FIG. 4 is a cross-sectional view of the upper end of the container similar to FIG. 3 but with the container open.

The container of the present invention, as shown in the embodiment illustrated in FIGS. 1 through 3 of the drawings, includes a cylindrical side wall 10, an upper lid 11 joined to the upper end of the side wall by a chime 12 and a bottom (not shown) of the same shape and diameter as the upper end to permit the containers to be stacked.

The lid 11 is recessed beneath the upper edge of the chime 12 and contains an opening 13 offset from the center of the lid. The keyhole shape of the opening as shown, facilitates pouring of liquid. The opening in the lid is closed by a cap 14 formed with a finger engaging ridge 15. A channel 16 having an inwardly extending bead 17, and a channel 18 having an inwardly extending bead 19, form a guideway on the lid 11 to hold the cap in position. The channels 16 and 18, shown formed integrally with the lid 11, can also be separate members affixed to the lid. Opposite sides of the cap 14 are contoured to fit and be held by the channel beads 17 and 19.

A seal 20 on the lid extends around the opening 13 and cooperates, when the container is closed, with a seal 21 projecting from the lower surface of the cap 14. The seal 21 can have a periphery slightly smaller than the periphery of the seal 20, as shown, or slightly larger, to provide for snap action of the cap 14 when it is moved into position over the opening 13, or the seals 20 and 21 can be of the same size to facilitate opening of the container. In addition, to provide a more effective seal, the underside of the lid and cap can be covered or sprayed with a thin, non-toxic resinous layer or liner 22 of the type sometimes utilized in flip-top tab closures used in conventional cans. If such an inner thin frangible seal is applied to the bottom of the lid and cap, the portion thereof which coincides with the opening will adhere to and remain with the cap.

To insure the integrity of the container when subjected to internal pressures on the order of 95 pounds per square inch, or when subjected to atmospheric pressure with the contents of the container under vacuum, the seals 20, 21 and 22 are formed of suitable plastic materials with approximate resilience to perform their function.

Camming surfaces 17*a* and 19*a*, formed by sloping the beads 17 and 19 downwardly toward the opening, as shown in FIG. 3, cooperate with the cap, as it is moved into position overlying the opening, to force the seals 20 and 21 into tight engagement.

When the container is to be opened, the user pulls or pushes the cap 14 along the guideway by finger pressure on the ridge 15. This breaks the seal around the opening 13, and when the cap is positioned across the lid from the opening, the container contents can be poured out. The cap, however, remains on the container.

The position of the channels along opposite sides of the opening, together with the upstanding chime, provide a natural pouring spout for the container. This arrangement also facilitates drinking of the contents directly from the container. If less than the entire container contents are used, the cap 14 is moved along the guideway and is cammed by beads 17 and 19 into its original sealed position, thereby reclosing the container.

Figure 5:
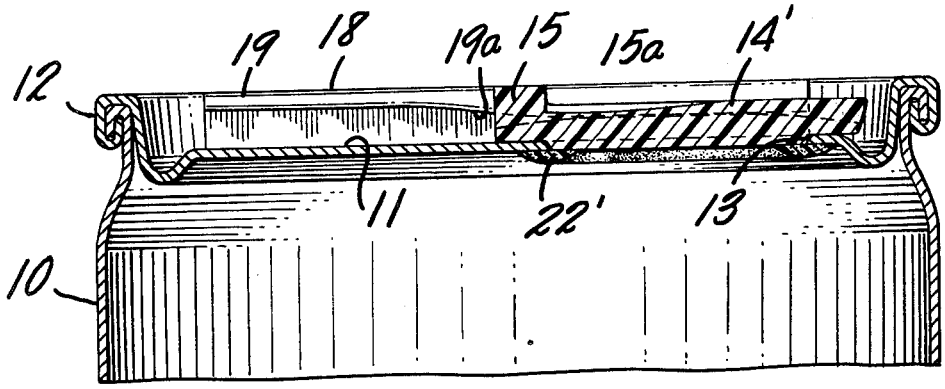
FIG. 5 is a cross-sectional view of the upper end of the container similar to that of FIG. 3 with another sealing arrangement in accordance with the invention.

Referring to FIG. 5, if it is unnecessary to have a fully effective seal when the container is reclosed, the seals 20 and 21 may be omitted. A cap 14' is shown overlying the opening 13 and the container is sealed by a thin, non-toxic resinous layer or liner 22' of the type sometimes utilized in the flip-top tab closures used in conventional cans. Movement of the cap 14' along the guideway breaks the seal 22' and opens the container. The cap can then be returned to its original position to reclose the container.

Figure 6:
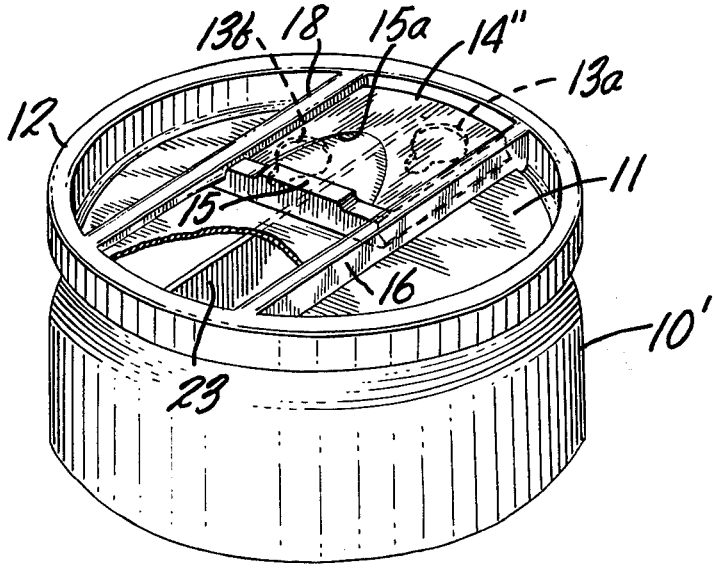
FIG. 6 is a perspective view of the upper portion of another container embodying the present invention.

As shown in FIG. 6, it is sometimes desirable to provide a container 10' with an interior partition 23 for holding two different liquids. For example, gin and tonic. To empty both liquids, two openings 13*a* and 13*b*, preferably staggered as shown, are provided in the lid 11. Each opening can have seals interfacing with complementary seals on the underside of the cap 14'' in the manner shown in FIGS. 1 through 3, or be sealed as shown in FIG. 5. Thus with the cap 14'' held in position by the channels 16 and 18, both openings are sealed, and when the cap is moved partially across the lid, the opening 13*a* can be used for pouring a portion of the container contents. When the cap is moved to the other side of the lid, the remaining contents can be poured through the second opening 13*b*.

While the cap 14 has been shown as formed of plastic, any suitable material such as metal may also be used. The cap may be snapped into position in the channels 16 and 18 or, if desired, it may be placed in position during the lid forming operation. Also, a seal or stamp can be affixed across the closed slidable cap and container which will be broken when the cap is opened to show that the contents have not been consumed or contaminated.

Figure 7:
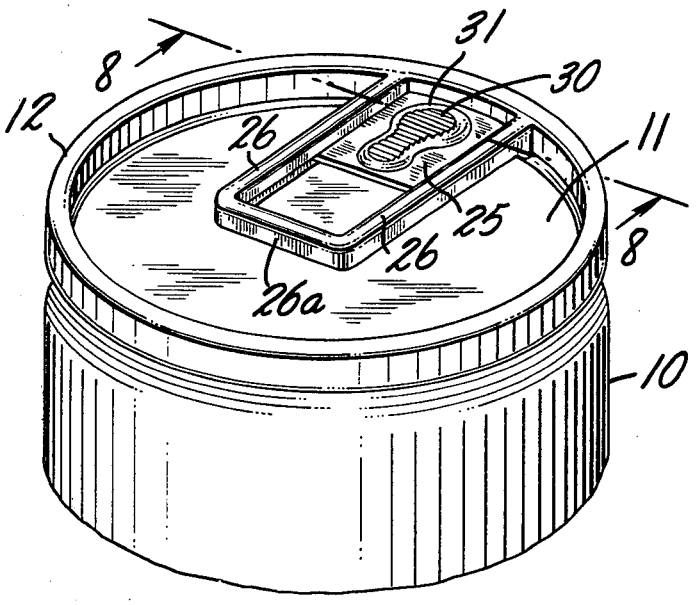
FIG. 7 is a perspective view of the upper portion of a container embodying another form of the invention.
Figure 8:
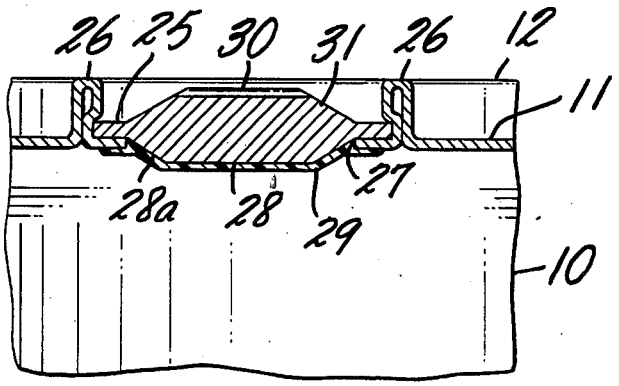
FIG. 8 is a cross-sectional view of the upper end of the container along the line 8—8 of FIG. 7 looking in the direction of the arrows.

FIGS. 7 and 8 show another embodiment of a container in which the slidable cap 25 is guided on the lid and between rails 26 for movement relative to an opening 27 in the lid of the container between the rails. Although the rails can extend across the lid of the container as shown in the other embodiments, in this embodiment the rails are shown extending part-way across the lid so that the guideway is terminated by an end rail or stop 26*a*.

The seal in the embodiment of FIGS. 7 and 8 is formed by a depending configuration 28 of complementary shape to the opening in the lid so that when the cap is in sealed position the depending configuration is seated and recessed within the complementary shaped opening. As in the other embodiments, an inner frangible seal 29 can be applied to the under surfaces of the lid and cap across the interface therebetween. The outer periphery of the depending configuration is gently curved at 28*a* so that as the cap is moved to open position the edge defining the opening will cam the recessed portion of the cap upwardly to lift it from its seated, recessed position within the opening.

To facilitate the sliding of the cap between closed and open positions, the upper surface of the cap is formed with a plurality of transverse ribs or serrations 30 to permit the slidable cap to be thumb actuated to open or closed position while held by the same hand. In the embodiment shown in FIGS. 7 and 8, the cap is also shown formed with a raised surface 31 of generally the same shape as the recessed surface 28 and the shape of the opening so as to form a thicker button-shaped portion in the slide cap which can either be solid or hollow, the latter facilitating the lifting action when the recessed portion is cammed upwardly by the edge of the opening in sliding it from closed to open positions.

FIGS. 9 through 12 show another embodiment of a container in which a slidable cap 35, formed with finger engageable ridges 35*a*, is guided by channels or rails 36 for movement relative to an opening 37 in a lid 11' of the container. The cap can be formed of metal or a suitable plastic. As in the embodiment of FIGS. 7 and 8, the rails extend partway across the lid and the guideway is terminated by an end stop 38. The guideway comprising the rails and stop is shown formed when the lid is stamped out. However, it may also be secured in an appropriate manner to the lid.

Figure 11:
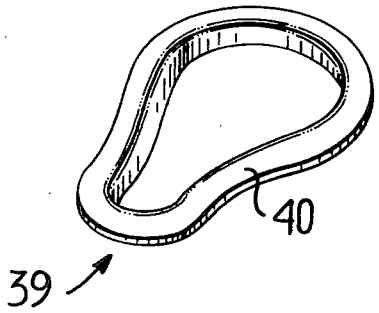
FIG. 11 is a perspective view of a discrete insert used in the container of FIG. 9.
Figure 12:
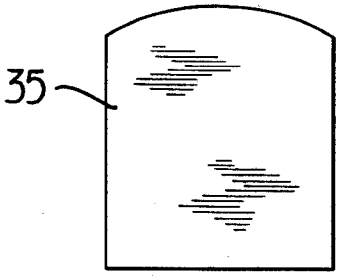
FIG. 12 is a plan view of the underside of the sliding cap or tab used in the container of FIG. 9.
Figure 10:
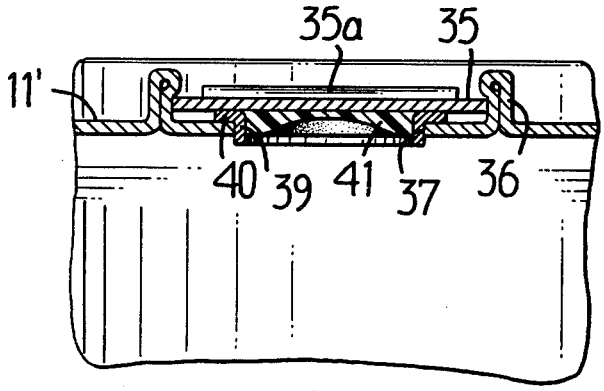
FIG. 10 is a cross-sectional view of the upper end of the container along the line 10—10 of FIG. 9 looking in the direction of the arrows.

To facilitate using the invention with conventional type cans having conventional thin metal lids, a discrete insert 39 (FIG. 10) is suitably secured and sealed in the keyhole shaped opening 37 in the lid 11'. As shown in FIGS. 10 and 11, the insert 39 is formed with an upper lip or flange 40 circumferentially extending around the opening 37. The insert can be welded, brazed or otherwise suitably fastened to the lid to provide an effective seal between the lid and the insert. The insert 39 is formed to facilitate its insertion into lids of conventional type containers without altering the thickness of the lid.

Figure 9:
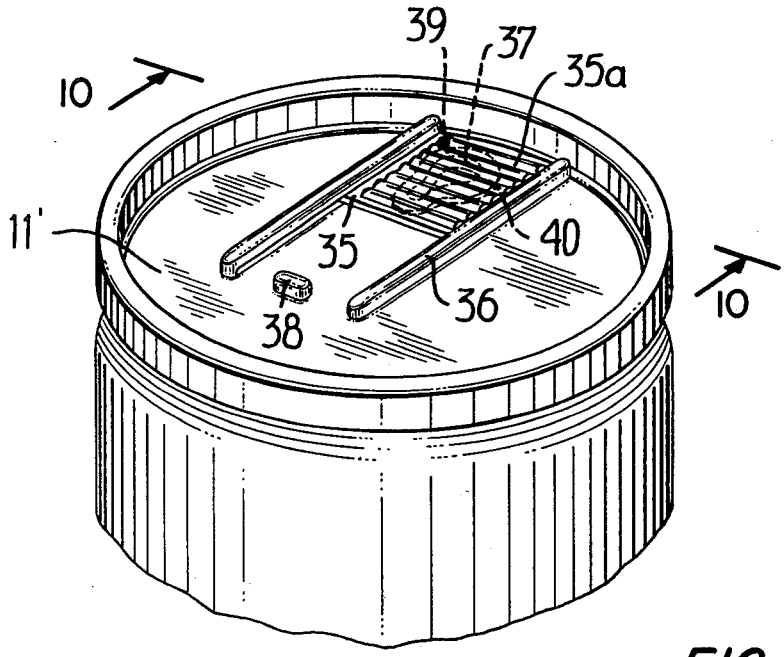
FIG. 9 is a perspective view of the upper portion of a container embodying another form of the invention.

When the sliding cap or tab 35 is in position over the opening 37, as shown in FIG. 9, it sealably engages the keyhole shaped flange 40. To provide a more effective seal, the insert and cap are covered or sprayed with a thin, non-toxic resinous and frangible layer or binder 41 of the type sometimes utilized in flip-top tab closures used in conventional cans. The portion of the thin seal, which coincides with the opening, will adhere to and remain on the underside of the cap after it is moved across the lid. With this arrangement, the integrity of the container will be assured with internal pressures on the order of 95 pounds per square inch, or when subjected to atmospheric pressure with the contents of the container under vacuum.

When the container is to be opened, the user pulls or pushes the slidable cap or tab 35 along the rails 36 by finger pressure on the ridges 35*a* to break the frangible seal 41 between the insert 39 and the cap. The cap, however, remains on the container. If less than the entire container contents are used, the cap 39 is moved along the guideway to its original sealed position, thereby reclosing the container.

FIGS. 13 through 17 show still another embodiment of a container in which a slidable cap 42 having finger engaging ridges 43 formed on the upper surface thereof is guided by channels or rails 44 for movement relative to an opening 45 in the lid of the container. As in the other embodiments of the invention, the slidable cap and guide rails are recessed below the upper edge of the upstanding chime 12 of the container.

The opening 45 is defined in this embodiment by a circular depending wall 46 which forms a seat for the slidable closure. A complementary seat 47 is formed on the underside of the slidable closure to enable the slidable cap to recess slightly within the lid when the slidable cap is properly aligned with the opening.

The rails 44 are formed with parallel longitudinally extending recesses 48, the inner ends of which are defined by the upright walls 44*a* of the guide rails. The slidable cap is formed with a pair of wings 43*a* extending outwardly in opposite directions from the slidable closure to engage the recesses 48, and the longitudinally extending edges 43*b* forming the ends of the wings are in proximity to and guided by the upright walls 44*a* of the rails to guide the slidable cap for movement between the guide rails and to prevent rotation of the slidable cap which would tend to disengage the wings from the recesses.

A seal 49 bridging the under surfaces of the lid and the slidable cap across the opening 45 hermetically seals the container. This inner thin seal, a nontoxic resinous material sprayed or otherwise applied to the bottom of the lid and slide closure, adheres to the under surfaces of the lid and slidable cap and forms an effective seal which can be easily broken when the slide closure is displaced from closed to open position. As best shown in FIG. 17, the interfacing surfaces 46 and 47 will tend to lift the slidable cap and break the seal 49 as the slidable cap is lifted onto the upper surface of the lid as it moves toward the open position.

The cammed surfaces 44*b* of the rails 44 which engage the upper surfaces of the wings 43*a*, as best shown in FIG. 17, are lower at one end of the guideway than at the other end of the guideway to force the slidable cap into closed seated position relative to the opening 45 and to permit the slidable cap to lift out of seated position and to slide along the upper surface of the lid as the slidable cap is displaced toward open position. The rails 44 converge inwardly at the ends 44*c* thereof to provide a stop for the slidable cap in open position.

The invention has been shown and described in preferred forms and by way of example only, and different variations and modifications can be made therein within the spirit of the invention. For example, the invention has been shown utilizing separate seals but effective seals can be obtained by applying resilient sealing materials in situ on the cap and/or opening in the manufacture thereof, such as by coating or spraying them with a non-toxic sealing material. The invention, therefore, is not intended to be limited to any particular form or embodiment except insofar as such limitations are expressly set forth in the claims.

I claim:

1. A container comprising means forming the upper end of a substantially rigid container, a lid recessed below the upper end of the container, at least one opening in the lid for the discharge of the contents of the container, a sliding cap for closing the opening, interfacing seals on the lid around the opening and on the cap to form an airtight seal, a guideway on the lid for slidably receiving and holding the cap on the lid, camming means engageable with the sliding cap to interlock the sliding cap with the opening, the cap when properly located along the guideway being held by said camming means with the interfacing seals in engagement to close the opening, and a finger engageable portion on the cap for moving it across the lid along the guideway for unsealing the opening.

2. A container as set forth in claim 1 in which the guideway comprises two parallel channels on the lid, and opposite sides of the cap slidably engaging the channels.

3. A container as set forth in claim 2 in which the channels are integrally formed with the lid.

4. A container as set forth in claim 2 in which said camming means includes cam surfaces formed on the channels to urge the cap toward the lid as it is moved along the guideway into position overlying the opening, thereby urging the interfacing seals into engagement.

5. A container as set forth in claim 1 in which the means forming the upper end of the container is an upstanding chime extending around the periphery of the lid and in which the lid and cap are recessed beneath the upper edge of the chime.

6. A container as set forth in claim 5 in which the guideway comprises two parallel channels on the lid, opposite sides of the cap slidably engaging the channels, the ends of the channels being contiguous to the chime portion adjacent to the opening to facilitate pouring of the contents from the container.

7. A container as set forth in claim 1 in which the seals can withstand pressures on the order of 90 pounds per square inch.

8. A container as set forth in claim 1 in which the seal on the lid extends along the periphery of the opening, and the seal on the cap projects from the lower surface of the cap and has the same contour and size as the lid seal.

9. A container as set forth in claim 1 in which the seal on the lid extends along the periphery of the opening, and the seal on the cap projects from the lower surface of the cap and has the same contour as the lid seal, the cap seal having the same contour but a different size than the lid seal to enable the seals to snap together as the cap is moved along the slide means into its closure position.

10. A container as set forth in claim 9 in which the cap seal is slightly smaller than the lid seal.

11. A container as set forth in claim 9 in which the cap seal is slightly larger than the lid seal.

12. A container as set forth in claim 1 in which a partition divides the container into two sections with the one opening communicating with one section, a second opening in the lid adjacent the one opening and communicating with the second section, and interfacing seals provided on the lid around the second opening and on the cap to form an airtight seal for the second opening.

13. A container as set forth in claim 12 in which the second opening is staggered on the lid with respect to the one opening to enable the contents of the container to be emptied seriatim from the two sections.

14. A container as set forth in claim 1 including a seal across the closed cap and container and affixed to both so that the seal will be broken when the cap is opened.

15. A container comprising means forming the upper end of a substantially rigid container, a lid recessed below the upper end of the container, at least one opening in the lid for the discharge of the contents of the container, a sliding cap for closing the opening, sealing means on the lid around the opening and on the cap to form an airtight seal, a guideway on the lid for slidably receiving and holding the cap on the lid, camming means engageable with the cap so that when the cap is located in the guideway in overlying relation to the opening the camming means functions to close and interlock the cap with the opening with the sealing means tightly sealing the opening, and a finger engageable portion on the cap for moving it across the lid along the guideway for unsealing the opening.

16. A container as set forth in claim 15 in which the sealing means comprises a sealing layer on the lid extending to the cap.

17. A container as set forth in claim 16 in which the layer is sprayed onto the lid and cap.

18. A container as set forth in claim 16 in which the layer is in the form of a tape.

19. A container as set forth in claim 15 in which the seals can withstand pressures on the order of 95 pounds per square inch.

20. A container as set forth in claim 15 in which the guideway comprises two parallel channels on the lid, and opposite sides of the cap slidably engaging the channels.

21. A container as set forth in claim 15 in which the channels are integrally formed with the lid.

22. A container as set forth in claim 20 in which the channels are affixed to the lid.

23. A container as set forth in claim 15 in which the camming means includes cam surfaces formed on the channels to urge the cap toward the lid as it is moved along the guideway into a position overlying the opening.

24. A container as set forth in claim 15 in which the means forming the upper end of the container is an upstanding chime extending around the outer periphery of the lid and in which the lid and cap are recessed beneath the upper edge of the chime.

25. A container as set forth in claim 24 in which the guideway comprises two parallel channels on the lid, opposite sides of the cap slidably engaging the channels, the ends of the channels being contiguous to the chime portion adjacent to the opening to facilitate pouring of the contents from the container.

26. A container as set forth in claim 15 in which the lid includes a discrete insert sealed into the opening in the lid.

27. A container as set forth in claim 26 in which the insert includes a flange surrounding the opening on the upper side of the lid and the sealing means includes a frangible sealing layer on the insert extending to the cap to seal the opening.

28. A container as set forth in claim 27 in which the sealing layer is sprayed on the insert and cap.

29. A container as set forth in claim 27 in which the sealing layer is in the form of a tape.

30. A container as set forth in claim 27 in which the seal can withstand pressures on the order of 95 pounds per square inch.

31. A container as set forth in claim 15 in which a partition divides the container into two sections with the one opening communicating with one section, a second opening in the lid is adjacent the first opening and communicating with the second section, and sealing means are provided on the lid and cap to form an airtight seal for the second opening.

32. A container as set forth in claim 31 in which the second opening is staggered on the lid with respect to the one opening to enable the contents of the container to be emptied seriatim from the two sections.

33. A container as set forth in claim 15 including a seal across the closed cap and container and affixed to both so that the seal will be broken when the cap is opened.

34. A container as set forth in claim 15 in which the sliding cap is formed with a depending configuration of substantially complementary shape to the opening in the lid so that in closed position it is seated and recessed in the opening, and including a cam surface forming at least part of the outer periphery of the depending configuration to cam the depending configuration upwardly as the latter engages the edge in sliding toward open position.

35. A container as set forth in claim 15 in which the guideway on the lid extends only part way across the lid of the container and including a stop to limit the movement of the cap in open position.

36. A container as set forth in claim 15 including transverse gripping means formed on the cap to facilitate sliding it between open and closed positions.

37. A container as set forth in claim 36 including a raised configuration on the upper surface of the cap and transverse gripping formations on the raised surface.

38. A container as set forth in claim 15 in which the guideway is defined in part by a pair of parallel guide rails mounted on the upper surface of the lid and recessed below the upper end of the container and including longitudinally extending recesses formed in the inner edges of said rails, a pair of upright walls defining the inner ends of the recesses, a pair of wings extending outwardly in opposite directions from said slidable cap and engaging the recesses and a pair of longitudinally extending edges forming the ends of the wings for guiding the slidable cap for movement from closed to open position between the guide rails and cooperating with the upright walls to prevent rotational movement of said slidable cap which would tend to disengage the wings from the recesses.

39. A container as set forth in claim 15 including a depending edge around the outer periphery of the opening forming a seat for the slidable cap and a complementary seat formed on the underside of the slidable closure to recess the slidable cap relative to the lid when the slidable cap is properly aligned with the opening.

40. A container as set forth in claim 15 in which said camming means includes longitudinally extending cammed surfaces defining part of the guideway to engage the upper surface of the slidable cap and urge it against the lid to seal the opening.

41. A container as set forth in claim 40 including cam means for raising the slidable cap above the upper surface of the lid as it is displaced from closed to open position.

* * * * *